US006918146B2

(12) United States Patent
England

(10) Patent No.: US 6,918,146 B2
(45) Date of Patent: Jul. 19, 2005

(54) ADJUSTABLE SEAT CUSHION FOR FURNITURE

(75) Inventor: Rodney England, New Tazewell, TN (US)

(73) Assignee: England, Inc., New Tazwell, TN (US)

( * ) Notice: Subject to any disclaimer, the term of this patent is extended or adjusted under 35 U.S.C. 154(b) by 48 days.

(21) Appl. No.: 10/465,522

(22) Filed: Jun. 19, 2003

(65) Prior Publication Data

US 2004/0255385 A1 Dec. 23, 2004

(51) Int. Cl.[7] ..... A47C 27/15; A47C 27/14

(52) U.S. Cl. ..... 5/653; 5/728; 5/643; 5/657; 297/452.27; 297/284.1

(58) Field of Search ..... 5/653, 657, 728, 5/643, 652; 297/452.27, 284.1

(56) References Cited

U.S. PATENT DOCUMENTS 2,815,515 A * 12/1957 McKinley ..... 428/101
3,148,389 A * 9/1964 Lustig ..... 5/645
3,287,750 A 11/1966 Jessup
3,638,255 A 2/1972 Sterrett
3,987,507 A 10/1976 Hall
4,080,675 A * 3/1978 Kanowsky et al. .... 297/452.58

FOREIGN PATENT DOCUMENTS

GB 999217 * 7/1965 ..... 5/657

* cited by examiner

*Primary Examiner*—Alexander Grosz
(74) *Attorney, Agent, or Firm*—Harness, Dickey & Pierce, P.L.C.

(57) ABSTRACT

The present invention provides an adjustable seat cushion for furniture that can be customized to an individual level of comfort by the user of the furniture. The adjustable seat cushion has an auxiliary support member that can be inserted into or removed from the support member of the cushion. The auxiliary support members come in a variety of firmnesses so that a desired level of comfort or firmness for the adjustable seat cushion can be achieved by selecting the appropriate auxiliary support member. The cushion can come with a piece of furniture as part of a kit that includes a group of auxiliary support members of varying firmnesses for each adjustable seat cushion on the piece of furniture.

31 Claims, 4 Drawing Sheets

FIG 4A
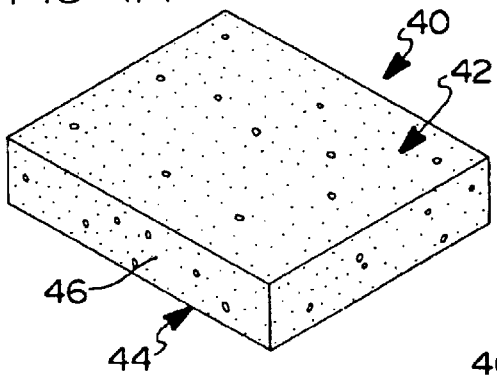
FIG 4D
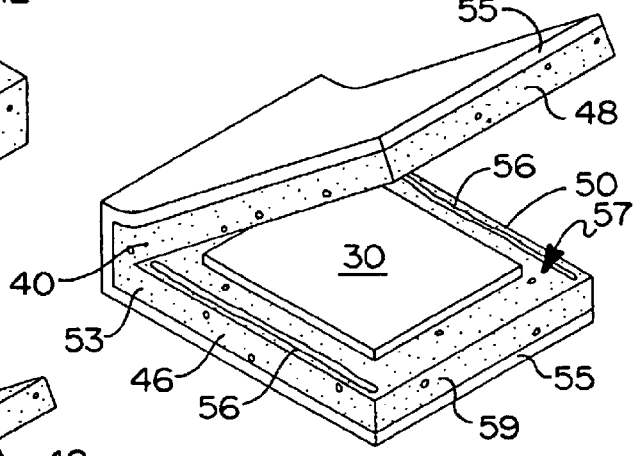
FIG 4B
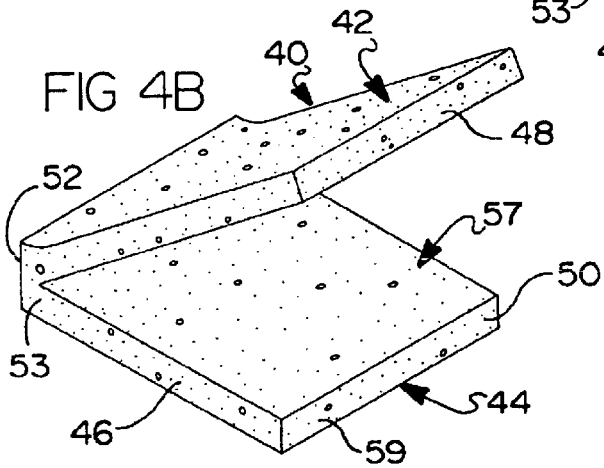
FIG 4E
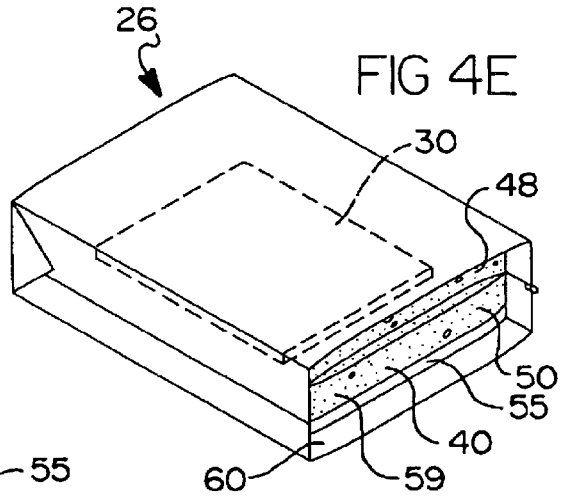
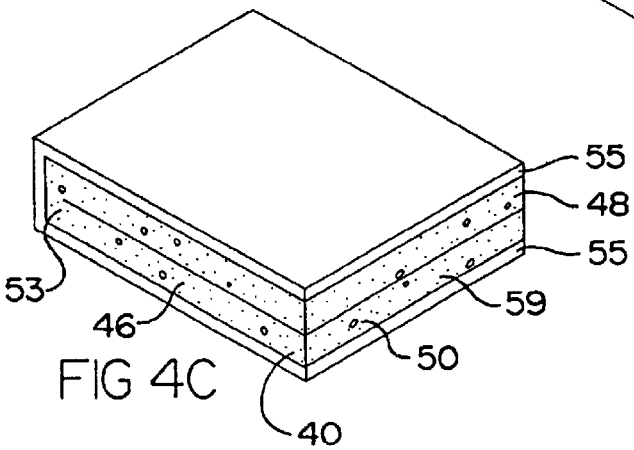
FIG 4C

ADJUSTABLE SEAT CUSHION FOR FURNITURE

FIELD OF THE INVENTION

The present invention relates to furniture and, more particularly, to an adjustable seat cushion for furniture.

BACKGROUND OF THE INVENTION

Pieces of furniture typically utilize one or more cushions to support users of the furniture. The cushions are compressible and provide comfort to a user residing on the cushion. The cushions typically come with a firmness or level of support that is approximately the same for each cushion on the piece of furniture. Users of the furniture, however, come in varying sizes and therefore varying weights and may prefer differing amounts of firmness or levels of support. Because the size of the users of the furniture can vary substantially, a cushion that is designed with a standard or fixed firmness or level of support may not provide the desired comfort to a user of that piece of furniture. Additionally, regardless of the size of the user, some users may prefer a firmer support while others prefer a softer support. Thus, it would be advantageous to provide a cushion for a piece of furniture that has a comfort level that can be adjusted.

Attempts have been made to provide a cushion with varying levels of support. For example, typical cushions consist of a foam core that is encased within a cover. The cover typically has some type of closure mechanism that can be opened to allow access to the interior of the cushion. To adjust the initial level of support or initial feel, polyester fiber is inserted inside the cushion cover to attain a customized level of initial support for the user of the cushion. The use of polyester fiber, however, results in a short term solution as polyester fiber has poor rebound memory which can result in a reduction of 10%–15% of the height within a short period of time. The lack of rebound memory effects the level of initial support provided by the cushion and may also result in an undesirable appearance for the cushion (i.e., lumpy or unevenness). Thus, it would be desirable to provide a cushion for use with furniture that has an adjustable level of support and maintains an aesthetically pleasing appearance. Additionally, it would be advantageous if each cushion of a piece of furniture could be individually customized to provide a customized level of support for users of that portion or cushion of the piece of furniture.

SUMMARY OF THE INVENTION

The present invention provides an adjustable seat cushion for furniture that can be customized to an individual level of comfort by the user of the furniture. The preset invention provides for such adjustability in an aesthetically pleasing appearance and allows each seat cushion to be individually customized by a user of that seat cushion.

An adjustable seat cushion according to the principles of the present invention includes a compressible support member having opposite top and bottom surfaces and at least one sidewall extending therebetween. The support member is divided into upper and lower portions along a first portion of the sidewall. The support member is continuous and undivided between the top and bottom surfaces along the second portion of the sidewall. There is at least one removable compressible auxiliary support member that is positioned between the upper and lower portions of the support member. A cover encloses the support member and has a closure mechanism that is operable to allow access to the support member to allow insertion and removal of the auxiliary support member.

The present invention also provides for a furniture kit that can be utilized to provide varying levels of comfort for each of the cushions on the furniture. The kit includes a piece of furniture and at least one adjustable cushion positioned on the piece of furniture. The cushion has a compressible support member with upper and lower portions that can be separated. A cover encloses the cushion and has a closure mechanism operable to allow access to the support member. Included as part of the kit are a plurality of auxiliary support members of multiple firmnesses. Each of the auxiliary support members is configured to be positioned between the upper and lower portions of the support member to customize the firmness of the cushion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIGS. 4A–E are perspective views of the various stages of construction of an adjustable seat cushion according to the principles of the present invention.

DETAILED DESCRIPTION OF THE PREFERRED EMBODIMENT

The following description of the preferred embodiment is merely exemplary in nature and is in no way intended to limit the invention, its application, or uses.

Figure 1A:
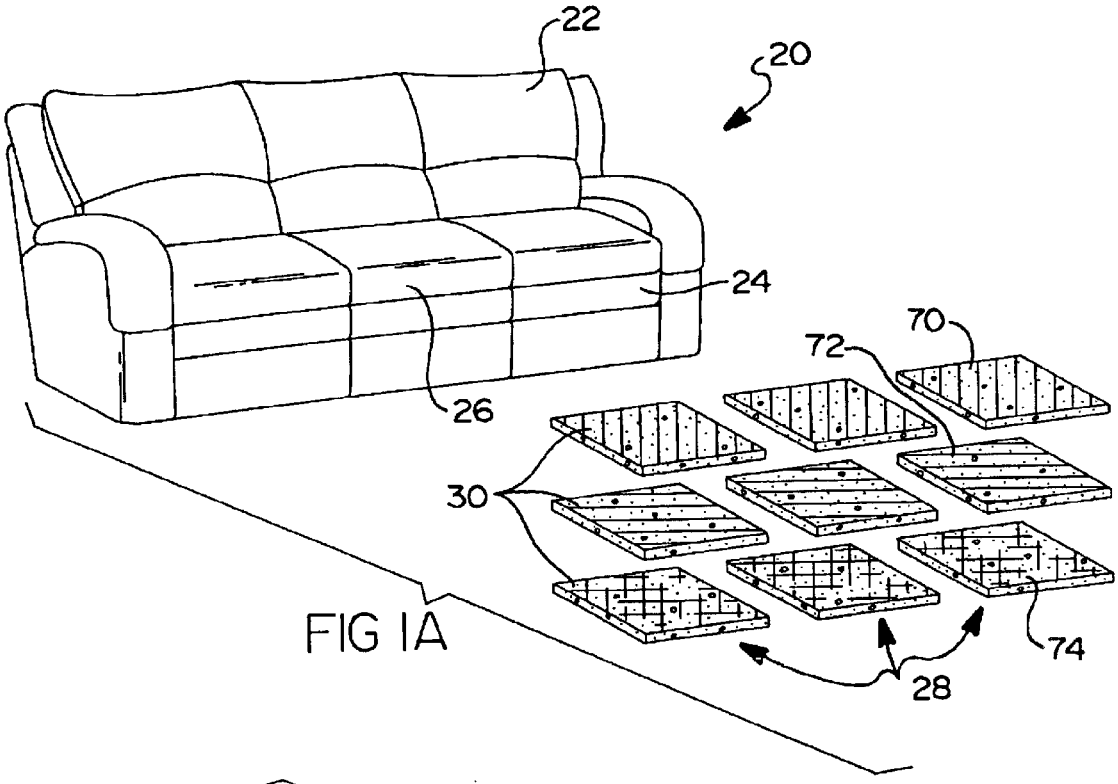
FIG. 1A illustrates a furniture kit according to the principles of the present invention which includes a sofa having adjustable seat cushions and a group of auxiliary support members for each of the adjustable seat cushions.
Figure 2A:
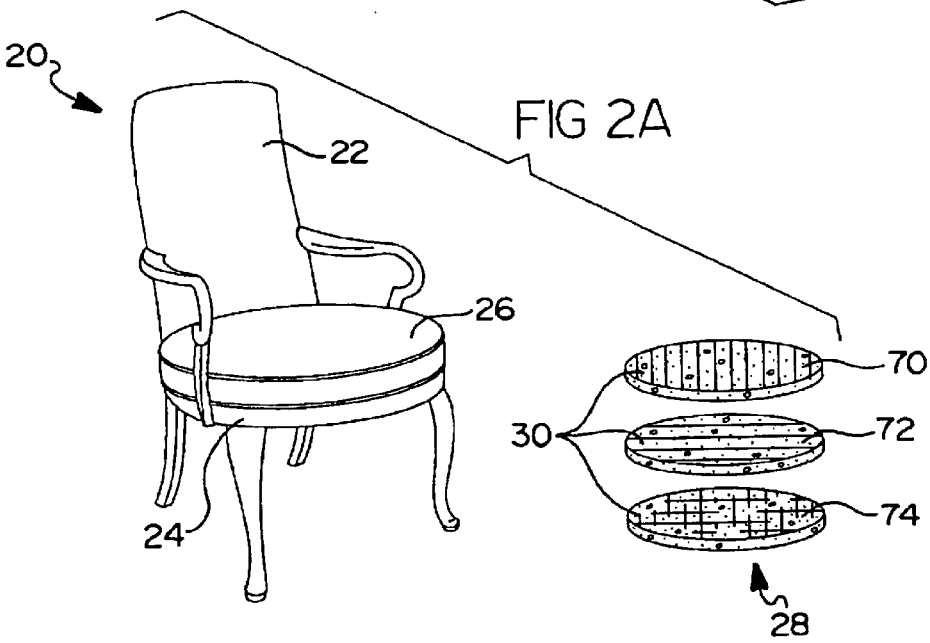
FIG. 2A illustrates a furniture kit according to the principles of the present invention which includes a chair having an adjustable seat cushion and a group of auxiliary support members for the adjustable seat cushion.
Figure 1B:
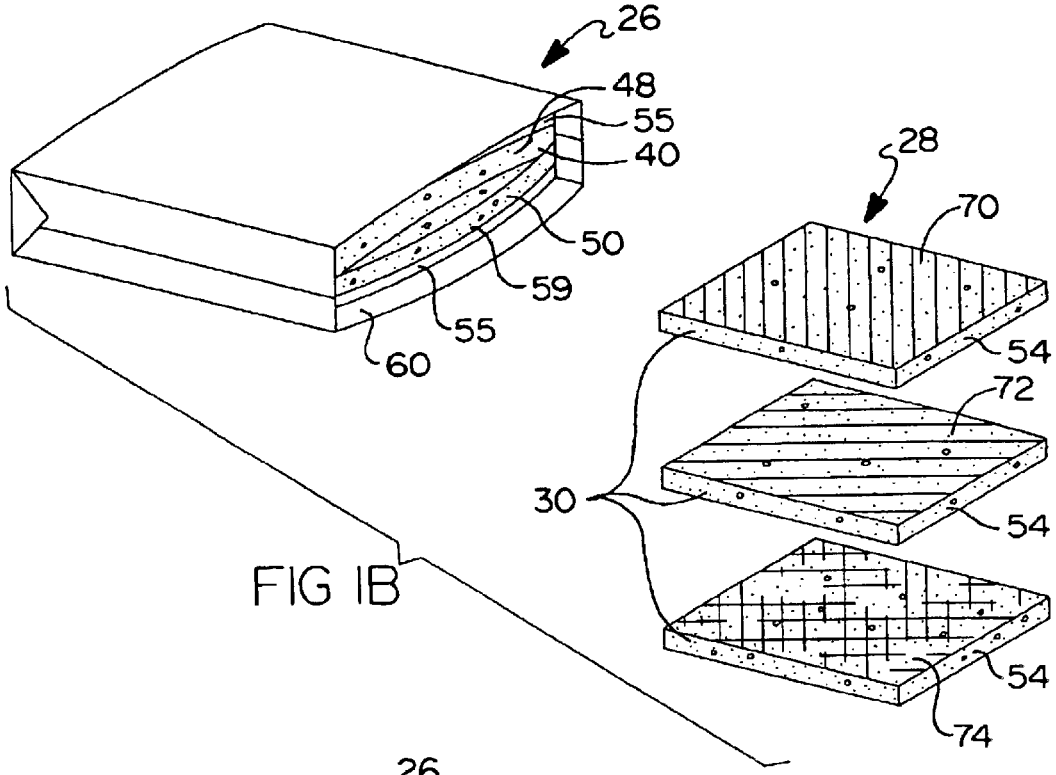
FIG. 1B is an enlarged perspective view of an adjustable seat cushion from the sofa of FIG. 1A along with a group of auxiliary support members that can be inserted into the adjustable seat cushion.
Figure 2B:
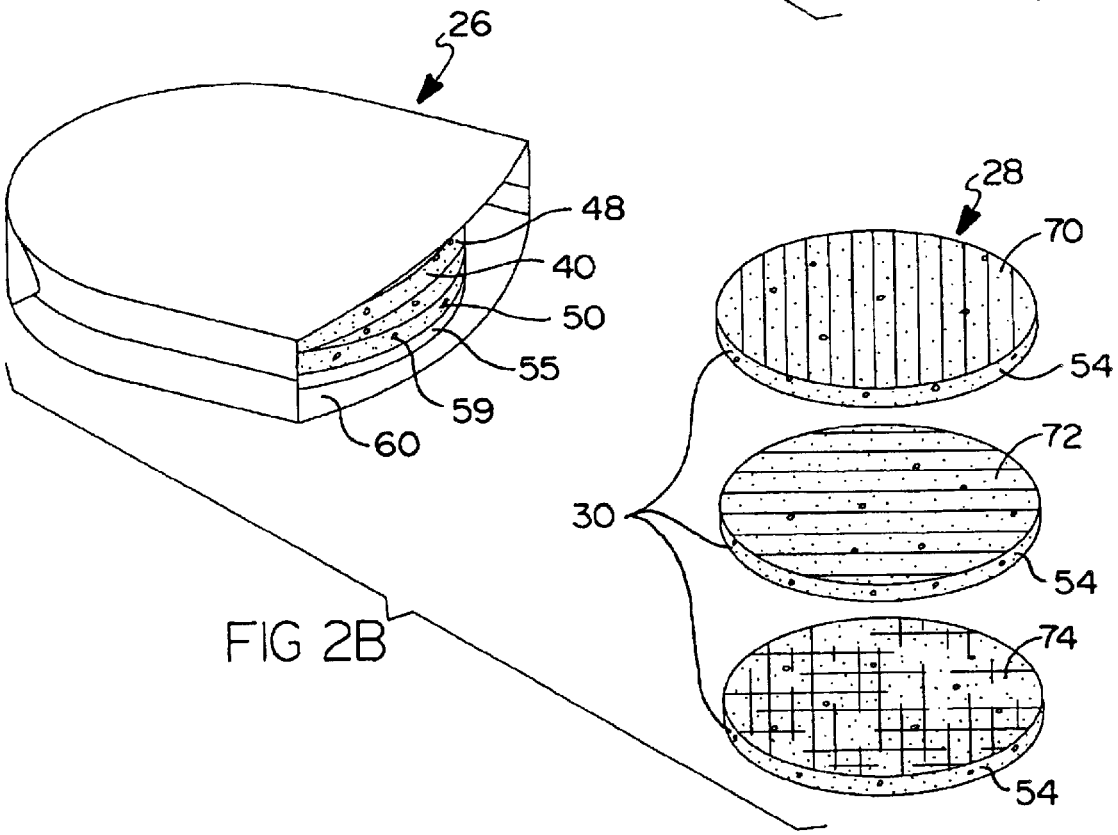
FIG. 2B is an enlarged perspective view of the adjustable seat cushion from the chair of FIG. 2A along with a group of auxiliary support members that can be inserted into the adjustable seat cushion.

FIGS. 1A and 2A each show a furniture kit 20 according to the principles of the present invention. Furniture kit 20 includes a piece of furniture 22 which has a support structure 24 on which one or more adjustable seat cushions 26 according to the principles of the present invention are positioned. Furniture piece 22 can come in a variety of shapes, configuration and sizes. For example, furniture piece 22 can be a sofa which is capable of supporting one or more users, as shown in FIG. 1A, or a chair which is capable of supporting a single user, as shown in FIG. 2A. Furniture kit 20 also includes a group 28 of auxiliary support members 30 for each adjustable seat cushion 26. Auxiliary support members 30, as shown in FIGS. 1B and 2B, are capable of being inserted into an adjustable seat cushion 26, as described below, to provide a customized level of comfort or support for a user of the seat cushion.

Figure 3A:
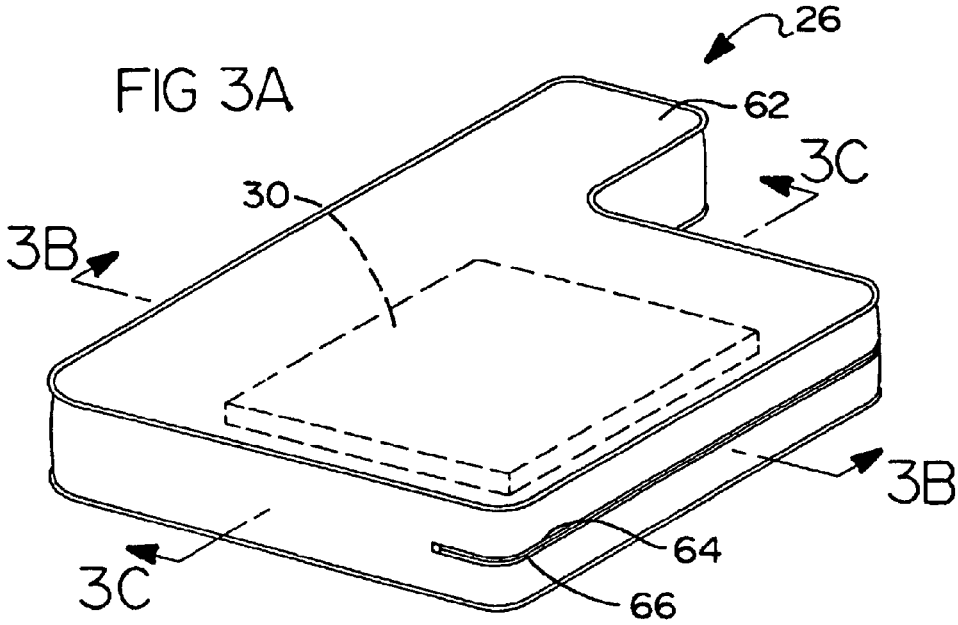
FIG. 3A is a perspective view of an adjustable seat cushion according to the principles of the present invention.

Adjustable seat cushion 26 can come in a variety of shapes and sizes depending upon the furniture piece 22 on which it is used. For example, adjustable seat cushion 26 can be rectangular in shape, as shown in FIGS. 1A–B, L-shaped, as shown in FIG. 3A, and circular or disk shaped, as shown in FIGS. 2A–B. Referring now to FIGS. 4A–E, each adjustable seat cushion 26 includes a support member 40 that has opposite top and bottom surfaces 42 and 44. Sidewall(s) 46 separate top and bottom surfaces 42 and 44 of adjustable seat cushion 26. The number of sidewalls 46 for a cushion 26 will vary depending upon the configuration of cushion 26. For example, when cushion 26 is circular or disk shaped there will be one sidewall 46, when cushion 26 is rectangular there will be four sidewalls 46 and when cushion 26 is L-shaped there will be six sidewalls 46. Support member 40, as shown in FIG. 4B, is sliced or cut along a portion of sidewall 46 to separate support member 40 into upper and lower portions 48 and 50. The slice or cut along the portion of sidewall 46 enables upper and lower portions 48 and 50 of support member 40 to be separated so that an auxiliary support member 30 can be inserted therebetween to provide a customized level of comfort or support for a user of adjustable seat cushion 26, as described below.

As shown in FIGS. 1B, 2B, 3B, and 4B–D only a portion of sidewall 46 is sliced or cut to form upper and lower portions 48 and 50. The remaining portion of sidewall 46 remains intact such that this portion of sidewall 46 is continuous between top and bottom surfaces 42 and 44 of support member 40. Preferably, a front sidewall 52 and part of adjacent sidewalls 53 are left intact. By maintaining front sidewall 52 and portions of adjacent sidewalls 53 intact, an aesthetically pleasing appearance for the front edge or portion of each adjustable seat cushion 26 is achieved. That is, the continuous and undivided nature of support member 40 between top and bottom surfaces 42 and 44 along the front and adjacent sidewalls 52 and 53 provides a uniform appearance for the front edge of adjustable seat cushion 26 and is not affected by the presence of an auxiliary support member 30.

Once adjustable seat cushion 26 has been sliced along sidewall 46, a layer of polyester fiber 55 is wrapped around top surface 42, front and sidewall 52 and bottom surface 44, as shown in FIG. 4C. Next, upper and lower portions 48, 50 are separated and auxiliary support member 30 is positioned between upper and lower portions 48, 50, as shown in FIG. 4D.

Each auxiliary support member 30 is shaped and dimensioned to fit between upper and lower portions 48 and 50 of support member 40 and inward from sidewall 46. That is, each auxiliary support member 30 is dimensioned so that sidewalls 54 of auxiliary support member 30 are inward of sidewall 46 of support member 40 when auxiliary support member 30 is assembled within support member 40 as described below.

With auxiliary support member 30 positioned within support member 40, a thin strip of adhesive 56 is applied along one or both opposing interior surfaces 57 of upper and lower portions 48, 50 adjacent the slit in sidewalls 46, as shown in FIG. 4D. Adhesive 56 does not extend along interior surface 57 adjacent a back portion 59 of support member 40. With adhesive 56 placed on interior surface 57, upper and lower portions 48, 50 are then moved back to an adjacent position so that adhesive 56 can hold upper and lower portions 48, 50 together with auxiliary support member 30 still being accessible through the slit in back portion 59 of support member 40.

Referring now to FIG. 4E, a muslin cloth 60 is then wrapped around polyester fiber layer 55 and support member 40. Specifically, a piece of muslin cloth 60 is wrapped around top surface 42, front sidewall 52 and bottom surface 44 with excess muslin cloth 60 extending outwardly therefrom. The excess muslin cloth 60 along sidewall 46 between front and rear sidewalls 52, 59 is then attached thereto with another layer of adhesive (not shown) with portions of muslin cloth 60 overlapping one another. The excess muslin cloth 60 that is adjacent rear sidewall 59 can be folded over rear sidewall 59 but is not affixed thereto so that access to auxiliary support member 30 is possible. Thus, muslin cloth 60 covers polyester fiber 55 and support member 40 and is only attached to support member 40 along side walls 46 between front and rear sidewalls 52, 59 and support member 40 and polyester fiber 55 are free to move about within muslin cloth 60 to a limited extent. The use of adhesive 56 to hold sections of upper and lower portions 48, 50 of support member 40 together in conjunction with muslin cloth 60 provides an aesthetically pleasing appearance for sidewall 46 between front and rear sidewalls 52, 59, which is similar to the appearance of front sidewall 52.

Figure 3B:
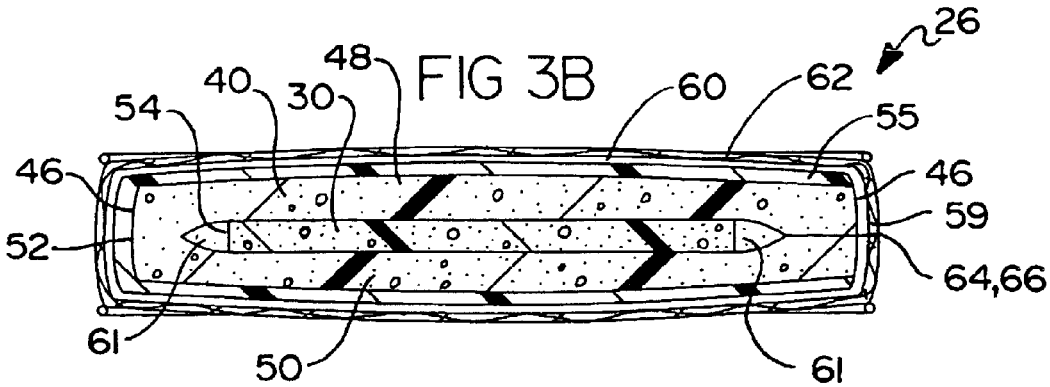
FIG. 3B is a cross sectional view of the adjustable seat cushion of FIG. 3A along line 3B—3B.
Figure 3C:
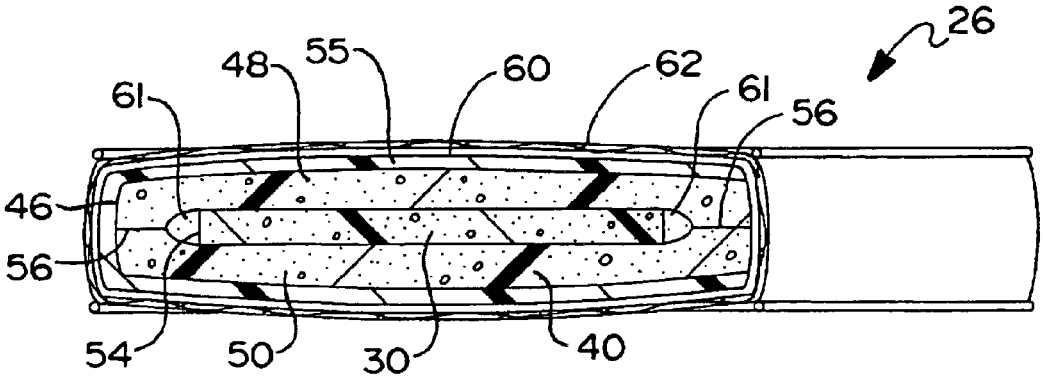
FIG. 3C is a cross sectional view of the adjustable seat cushion of FIG. 3A along line 3C—3C.

Referring to FIGS. 3B–C, auxiliary support members 30 are sandwiched between upper and lower portions 48 and 50 with small pockets or voids 61 along sidewalls 54. Sandwiching of auxiliary support member 30 between upper and lower portions 48 and 50 of support member 40 gives adjustable seat cushion 26 a crowned appearance. In other words, the thickness of adjustable seat cushion 26 is largest in a central portion and tapers toward end portions of adjustable seat cushion 26 as a result of having an auxiliary support member 30 within support member 40. Alternatively, auxiliary support members 30 can have a tapered edge(s) (not shown) to minimize and/or eliminate voids 61.

Each adjustable seat cushion 26 is enclosed within a cover 62 that has a closure mechanism 64 operable to allow access to support member 40 for insertion and removal of an auxiliary support member 30. Closure mechanism 64 can come in a variety of forms. For example, closure mechanism 64 can be a zipper 66, as shown, a hook and loop fastener, snaps, buttons or the like that allows access to support member 40.

Auxiliary support members 30 come in a variety of firmnesses to allow a customized level of comfort or support to be achieved with each adjustable seat cushion 26. Specifically, each adjustable seat cushion 26 is provided with a group 28 of auxiliary support members 30. Each group 28 will have a variety of different auxiliary support members 30 of varying degrees of firmness. For example, as shown, each group 28 has three auxiliary support members 30. A first auxiliary support member 70 has a first level of firmness, such as soft, a second auxiliary support member 72 has a second level of firmness, such as medium, and a third auxiliary support member 74 has a third level of firmness, such as firm. These various auxiliary support members 30 can be color coded, as shown, to simplify the identification of the soft, medium and firm auxiliary support members 30. Alternatively, other indicia (not shown) can be employed to simplify the identification of the various firmnesses of auxiliary support members 30.

To adjust or customize the level of comfort of adjustable seat cushion 26, cushion 26 is removed from furniture piece 22. Closure mechanism 64 is moved to an open position and upper and lower portions 48 and 50 are separated, as shown in FIGS. 1B and 2B. A selected auxiliary support member 30 is then centrally inserted within cushion 26 between upper and lower portions 48 and 50. Closure mechanism 64 is then closed and cushion 26 can be tested by the user to ascertain if the desired level of comfort was achieved. If it is desired to change the level of comfort, cushion 26 can again be opened to allow the insertion of another auxiliary support member 30 or the replacement of the existing auxiliary support member 30 with a different auxiliary support member 30. These adjustments to cushion 26 can be made at home, at the store where the furniture piece 22 was sold or in the warehouse prior to delivery based upon a customer's specified order. Auxiliary support members 30 can be provided as a group 28 and sold as part of a furniture kit 20 or can be sold individually to users of the furniture piece 22.

Support member 40 is preferably made from a foam such as urethane. Similarly, auxiliary support members 30 are also preferably made from foam, such as urethane. Auxiliary support members 30, as stated above, come in a variety of firmnesses. The firmness of an auxiliary support member 30 can be the same as the firmness of support member 40 or can be different. Additionally, one or more support members 30 can be positioned together and sandwiched between upper and lower portions 48 and 50 of support member 40 to provide the desired level of comfort or support.

The interaction of the surfaces of auxiliary support member 30 and that of upper and lower portions 48 and 50 inhibit the movement of auxiliary support member 30 relative to support member 40. In other words, the surface interactions inhibit and/or prevent auxiliary support member 30 from moving around within support member 40 such that auxiliary support member 30 does not become bunched up or shifted toward one of its sidewalls thereby avoiding a lumpy appearance and/or uncomfortable support for a user of cushion 26. Additionally, muslin cloth 60 allows movement of the cushion within cover 62 without binding on the rough interior surface of cover 62.

Thus, an adjustable seat cushion according to the principles of the present invention has a level of comfort or support (firmness) that can be customized. Each cushion on a particular piece of furniture can be individually customized by a user of that cushion. The simple construction of the adjustable seat cushion provides for a low cost and effective way of providing individual customization while avoiding the high cost of labor and materials to use glue or other adhesive means to attach various pieces of an adjustable cushion together. The maintaining of the front portion of the support member in a solid intact piece provides an aesthetically pleasing appearance and also allows the achievement of a crowned appearance for the adjustable seat cushion.

It should be appreciated that various alterations and deviations from the above described description of an adjustable seat cushion and furniture kit according to the principles of the present invention can be employed without departing from the spirit and scope of the invention. The shape and configuration of each adjustable seat cushion 26 can vary depending upon the piece of furniture 22 on which it is employed. The specific furniture piece 22 can also deviate from those shown. For example, furniture piece 22 can be a loveseat, a lounge, a sectional or the like. The projection on the L-shaped cushion could also be sliced part way through to allow the insertion of an auxiliary support member 30 therein. A cavity between upper and lower portions 48 and 50 can be employed to provide a void in which an auxiliary support member 30 may be inserted to reduce and/or eliminate a crowning of adjustable seat cushion 26. Furniture kit 22 can include a group 28 of auxiliary support members 30 that are more or less than three. Further, it should be appreciated that support member 40 and auxiliary support member 30 can be made from other resilient and compressible materials than those disclosed. Additionally, auxiliary support members 30 can be dimensioned so that sidewalls 56 of auxiliary support members 30 extend outward to the sidewalls of upper and lower portions 48 and 50. Thus, the description of the invention is merely exemplary in nature and variations that do not depart from the essence of the invention are intended to be within the scope of the invention. Such variations are not to be regarded as a departure from the spirit and scope of the invention.

What is claimed is:

1. An adjustable seat cushion comprising:

a compressible unitary slab support member having opposite top and bottom surfaces and at least one sidewall extending therebetween, said unitary slab support member being sliced along a first portion of said sidewall into upper and lower portions, and said unitary slab support member being continuous, uninterrupted and unsliced between said top and bottom surfaces along a second portion of said sidewall;

at least one removable compressible auxiliary support member positioned between said upper and lower portions of said support member; and a cover enclosing said unitary slab support member and having a closure mechanism operable to allow access to said unitary slab support member to allow insertion and removal of said auxiliary support member.

2. The cushion of claim 1, wherein said at least one sidewall is one of at least four sidewalls and said second portion includes at least one of said four sidewalls.

3. The cushion of claim 2, wherein said second portion includes an entirety of one sidewall and portions of at least two other sidewalls adjacent said one sidewall.

4. The cushion of claim 1, wherein said second portion of said sidewall is a front portion of said sidewall.

5. The cushion of claim 1, wherein the cushion is rectangular.

6. The cushion of claim 1, wherein the cushion is L-shaped.

7. The cushion of claim 1, wherein said closure mechanism is a zipper.

8. The cushion of claim 1, wherein said unitary slab support member has a first firmness and said auxiliary support member has a second firmness different from said first firmness.

9. The cushion of claim 1, wherein said auxiliary support member is made from foam.

10. The cushion of claim 1, wherein said unitary slab support member is made from foam.

11. The cushion of claim 1, wherein the cushion is crowned.

12. The cushion of claim 1, wherein said auxiliary support member has at least one sidewall and is dimensioned to lit between said upper and lower portions of said unitary slab support member and said sidewall of said auxiliary support member is positioned inward from said sidewall of said unitary slab support member.

13. The cushion of claim 1, wherein sections of said upper and lower portions adjacent said first portion of said sidewall are attached together.

14. The cushions of claim 13, wherein said sections of said upper and lower portions are attached together with an adhesive.

15. The cushion of claim 13, wherein said sections are side sections of said unitary slab support member between front and rear portions of said unitary slab support member.

16. A piece of furniture having an adjustable comfort level, the furniture comprising:

a support structure configured for supporting a user of the furniture;

at least one adjustable seat cushion positioned on said support structure, said cushion including:

a compressible unitary slab support member having opposite top and bottom surfaces and at least one sidewall extending therebetween, said unitary slab support member being sliced along a first portion of said sidewall into upper and lower portions, and said unitary slab support member being continuous, uninterrupted and unsliced between said top and bottom surfaces along a second portion of said sidewall;

at least one removable compressible auxiliary support member positioned between said upper and lower portions of said unitary slab support member; and a cover enclosing said unitary slab support member and having a closure mechanism operable to allow access to said unitary slab support member to allow insertion and removal of said auxiliary support member.

17. The furniture of claim 16, wherein said support structure is a sofa.

18. The furniture of claim 16, wherein said support structure is a chair.

19. The furniture of claim 16, wherein said support structure is configured to support at least two users.

20. The furniture of claim 16, wherein said at least one adjustable seat cushion is one of a plurality of adjustable seat cushions.

21. The furniture of claim 16, wherein said second portion of said sidewall is a front portion of said sidewall.

22. The furniture of claim 16, wherein said unitary slab support member has a first firmness and said auxiliary support member has a second firmness different from said first firmness.

23. The furniture of claim 16, further comprising a plurality of auxiliary support members of varying firmnesses that can be inserted into and removed from said at least one adjustable seat cushion to provide a desired level of comfort.

24. The furniture of claim 16, wherein sections of said upper and lower portions adjacent said first portion of said sidewall are attached together with an adhesive.

25. A furniture kit comprising:

a piece of furniture;

at least one adjustable cushion positioned on said piece of furniture, said cushion having a compressible unitary slab support member with opposite top and bottom surfaces and at least one sidewall extending therebetween, said unitary slab support member being sliced along a first portion of said sidewall into upper and lower portions that can be separated, and said unitary slab support member being continuous, uninterrupted and unsliced between said top and bottom surfaces along a second portion of said sidewall;

a cover enclosing said cushion and having a closure mechanism operable to allow access to said unitary slab support member; and a plurality of auxiliary support members having varying firmnesses, each of said auxiliary support members being configured to be positioned between said upper and lower portions of said unitary slab support member to customize the firmness of said cushion.

26. The kit of claim 25, wherein said piece of furniture is a sofa.

27. The kit of claim 25, wherein said piece of furniture is a chair.

28. The kit of claim 25, wherein said piece of furniture is configured to support two or more users.

29. The kit of claim 25, wherein said at least one adjustable seat cushion is one of a plurality of adjustable seat cushions.

30. The kit of claim 29, wherein there is a group of auxiliary support members of varying firmnesses for each of said adjustable cushions.

31. The kit of claim 25, wherein said second portion of said sidewall is a front portion of said unitary slab support member.

* * * * *